US008696287B2

(12) United States Patent
Sturnick et al.

(10) Patent No.: US 8,696,287 B2
(45) Date of Patent: Apr. 15, 2014

(54) IN-LINE AND OFF-LINE COVERS FEED FOR BINDING BOOK SOLUTIONS

(75) Inventors: Gerard R. Sturnick, Rochester, NY (US); Timothy J. Kelley, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 1236 days.

(21) Appl. No.: 11/608,914

(22) Filed: Dec. 11, 2006

(65) Prior Publication Data

US 2008/0138170 A1 Jun. 12, 2008

(51) Int. Cl.

| | |
|---|---|
| ***B42C 9/00*** | (2006.01) |
| ***B42C 11/00*** | (2006.01) |
| ***B42B 9/00*** | (2006.01) |
| ***B42C 11/04*** | (2006.01) |

(52) U.S. Cl.
USPC ..... 412/4; 412/1; 412/5; 412/16; 412/20; 412/21

(58) Field of Classification Search
USPC ..... 412/4–6, 8, 16, 20–21, 37; 399/408; 270/58.03, 58.08, 52.02
See application file for complete search history.

(56) References Cited

U.S. PATENT DOCUMENTS

| | | | | |
|---|---|---|---|---|
| 4,602,776 | A | 7/1986 | York et al. | |
| 5,207,412 | A | 5/1993 | Coons, Jr. et al. | |
| 5,465,213 | A | 11/1995 | Ross | |
| 6,142,721 | A | 11/2000 | Marsh | |
| 6,193,458 | B1 | 2/2001 | Marsh | |
| 6,206,358 | B1 * | 3/2001 | Yamaguchi et al. | 412/4 |
| 6,416,082 | B1 * | 7/2002 | Gayoso | 281/29 |
| 2002/0031268 | A1 | 3/2002 | Prabhakar et al. | |
| 2003/0063097 | A1 | 4/2003 | Prabhakar et al. | |
| 2004/0098665 | A1 * | 5/2004 | Kasahara et al. | 715/500 |
| 2006/0028662 | A1 * | 2/2006 | Dobrovolsky | 358/1.9 |
| 2006/0210379 | A1 * | 9/2006 | Kearns | 412/4 |

* cited by examiner

*Primary Examiner* — Kyle Grabowski

(74) *Attorney, Agent, or Firm* — MH2 Technology Law Group LLP

(57) ABSTRACT

A method and system for on-demand book production is provided in which covers and book content are synchronized at book binding equipment. In one exemplary system and method, a single printer prints a book cover followed by its corresponding book block. The cover and book block are each sequentially staged and synchronized together for binding in the binding equipment. In another method and system for on-demand book production, covers are printed and encoded at a first printer and a book block printing instruction is initiated in response to decoding of the cover in the binding equipment. Printing of the book block is in a separate but integrated printer and the book block is fed to the binding equipment for binding with the book cover. In each instance, synchronized book covers and book blocks are bound in and output from the binding equipment.

1 Claim, 4 Drawing Sheets

IN-LINE AND OFF-LINE COVERS FEED FOR BINDING BOOK SOLUTIONS

DESCRIPTION OF THE INVENTION

1. Field of the Invention

The present invention generally relates to book production and, more particularly, to "on demand" book production in which it is automatically determined what book block to release at a print request, and in which book covers and book blocks are synchronized prior to binding.

2. Background of the Invention

Conventional book binding equipment typically utilizes a system where the book content and book cover are completely separate production processes.

The separate production processes found in the conventional book binding industry typically include the printing of a book block on a first printer and binding the book block to a cover at a separate location, not connected to the printer. Other distinct book production processes that occur separately can include printing of the cover, trimming of a bound book block and cover, and laminating or coating procedures. Outputting a bound book from several distinct production processes can lead to errors. For example, there arises a need for manual steps to synchronize matching and assembly of a book block with a corresponding cover, particularly when various processing units are utilized. Errors tend to occur in the correlation of covers to corresponding book content, regardless of the number and location of printing the respective book parts. Further examples of errors include mismatch problems occurring when the wrong book block is associated with a cover. Miscount problems occur when the number of printed covers is different than the number of printed book blocks. Accordingly, manual intervention is known to result in errors, waste, and inefficient workflow and productivity.

Furthermore, recovery from these problems can be difficult. For example, if a printing system detects a book block/cover mismatch in a finishing system (such as the Xerox DigiFinish™ system); the system shuts down to avoid binding a book block to the wrong cover. As a result, paper fills the entire paper path of the printing system and the finishing system. Clearing the paper path can be time consuming.

Thus, there is a need to overcome these and other problems and to provide a synchronized method and apparatus for book production.

SUMMARY OF THE INVENTION

In accordance with the present teachings, a method of book production is provided. The exemplary method can include selecting at least one book for printing. At least one book cover is sequentially printed with a corresponding book block on a common printer. The at least one printed cover is directed to a cover staging portion of a binder. The printed pages of a book block are automatically delivered to the binder. The at least one printed cover is merged with the printed book block. Binding the merged printed cover and printed book block occurs and a bound book is output.

In accordance with the present teachings, another method of book production is provided. The exemplary method can include selecting at least one book for printing and printing at least one book cover corresponding to the selected book. The at least one printed book cover is encoded and pre-fed into a staging area of a book binder. Decoding the encoded portion of the book cover occurs in a decoding area of the book binder. Printing of a book block (typically, a plurality of pages) occurs in response to an identification of the decoded information. The printed book block is loaded into the book binder for binding with the corresponding cover within the binder, and a bound book is output.

In accordance with the present teachings, a book production system is provided. The exemplary book production system can include an input for placing a book print request. A cover printer is provided for printing at least one book cover, the book cover including encoded information. A book binder includes a cover staging area and a binding area. A decoder, provided in connection with the book binder cover staging area, interprets encoded cover information. In response to the decoder, a separate printer prints a book block corresponding to decoded information of the at least one printed cover. The book binder merges the printed book block with the corresponding book cover in the binding area of the book binder, and a finished book is output.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

FIGS. 1 through 4 depict exemplary systems and methods for on-demand book production. The exemplary systems and methods include in-line production in which a cover and corresponding book block are printed on a common printer, the cover and book block being synchronized in the binding equipment. Transporting of the cover and book block to the binding equipment can occur automatically. The exemplary systems and methods also include off-line book production in which encoded covers are used to generate book block printing and synchronize a printed and encoded cover with a corresponding book block, the book block print request being initiated at the binder. All functions are automated.

As used herein, the terms "perfect binder" or "perfect binding" refer to a book binding process wherein the spine of a book block is milled in a manner to expose paper fibers for enhanced adhesion.

As used herein, the term "book block" is intended to encompass any number of printed pages for binding within a cover. Further, the explicit term "book" is intended to encompass such materials as magazines, manuals, pamphlets, and virtually any viewable (bindable) printed product.

Figure 1:
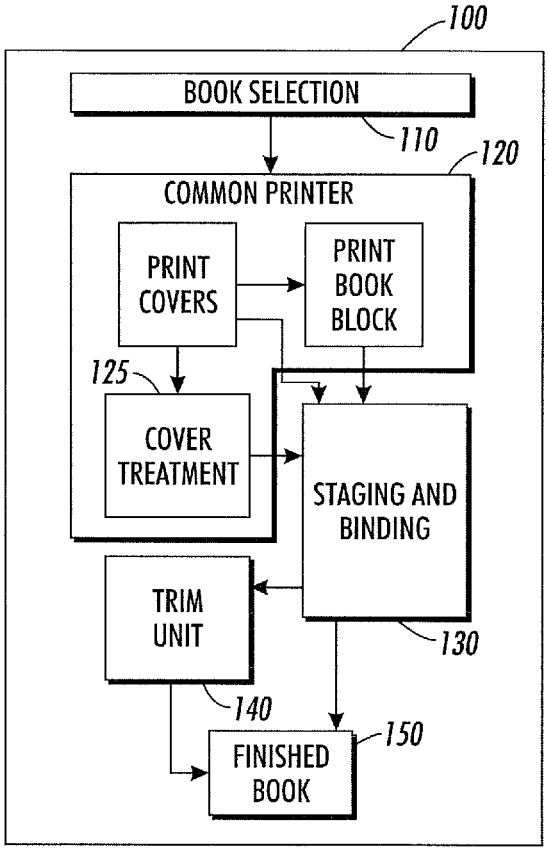
FIG. 1 depicts an exemplary architecture for a book production system in accordance with embodiments of the present teachings.

Referring to FIG. 1, an exemplary architecture for an in-line book production system is depicted. The exemplary architecture can implement in-line methods of book production described in connection with FIG. 2, as well as other exemplary methods disclosed herein.

In FIG. 1, the structure illustrated generally at 100 includes a book selection function 110, a common printer 120, an optional cover treatment unit 125, a staging and binding unit 130, an optional trimming unit 140, and an output location 150 for a finished book.

Book selection function 110 can be, for example, a computerized book selection at an in-house site, a remote book selection site such as an internet purchase, or other repository such as a library or store. Selection will likely be based on a listing available for printing at the time of selection. Although the typical result is an on-demand or immediate local processing of the book selection, such is not intended to limit the subject matter of exemplary embodiments.

The common printer 120 refers to a printer intended to print both a book cover and book block. The printer can be a color printer or a black-and-white printer. Further, the printer can print the book cover in color followed by printing of the book block in black-and-white, or any combination thereof. In an exemplary embodiment, the common printer 120 will first print a book cover, followed by a corresponding book block. It will also be apparent that a selection of multiple books can be processed by first printing multiple book covers followed by printing a corresponding multiple of book blocks. The selections can be for multiple copies of one book or multiple different books, of one or more copies each. In any instance, however, a book block is printed in connection with printing of its cover and at the same printer. This printing of the book block can occur immediately following the printing of the corresponding book cover, or printing of more than one book block can follow the printing of more than one cover.

In the event that the book cover will be additionally treated, a cover treatment unit 125 is provided subsequent to printing of the book cover. The cover treatment can be any known cover treating device including laminating, coating, varnish, veneer, or other treatments to improve the appearance, durability or scuff resistance of the cover. For a laminating or coating type of unit, it will be appreciated that the treatment can be a known fast treatment device as typically used in the printing art. Further, by way of example, laminating can include coating of the cover and then either ultraviolet (UV) curing or air curing the coated cover.

Referring still to FIG. 1, the staging and binding unit 130 of the book production system 100 accepts one or more printed covers in a sequential staging area, and matches the printed book block to its printed cover. Matching of the book cover to the book block occurs as a one-to-one correspondence of the printed cover to the printed book block, thereby eliminating any matching errors therebetween. In essence, a manual step has been automated by triggering the one-to-one correspondence of printed book covers to printed book blocks.

Upon matching the printed cover to the printed book block, the matched components are bound together. Binding of the printed cover with the printed book block may be, for example, at an in-line perfect binder such as that manufactured by CP Bourg™.

In some instances, it may be desired to trim the covered bound book block as provided for at trimming unit 140. The trimming unit 140 can be a three-knife trimmer in order to trim the three unbound edges of the covered and bound book block. An example of a three-knife trimmer is that manufactured by Challenge™. Upon binding and optionally trimming the covered and bound book block, a completed book can be output from the in-line book production system 100.

Figure 2:
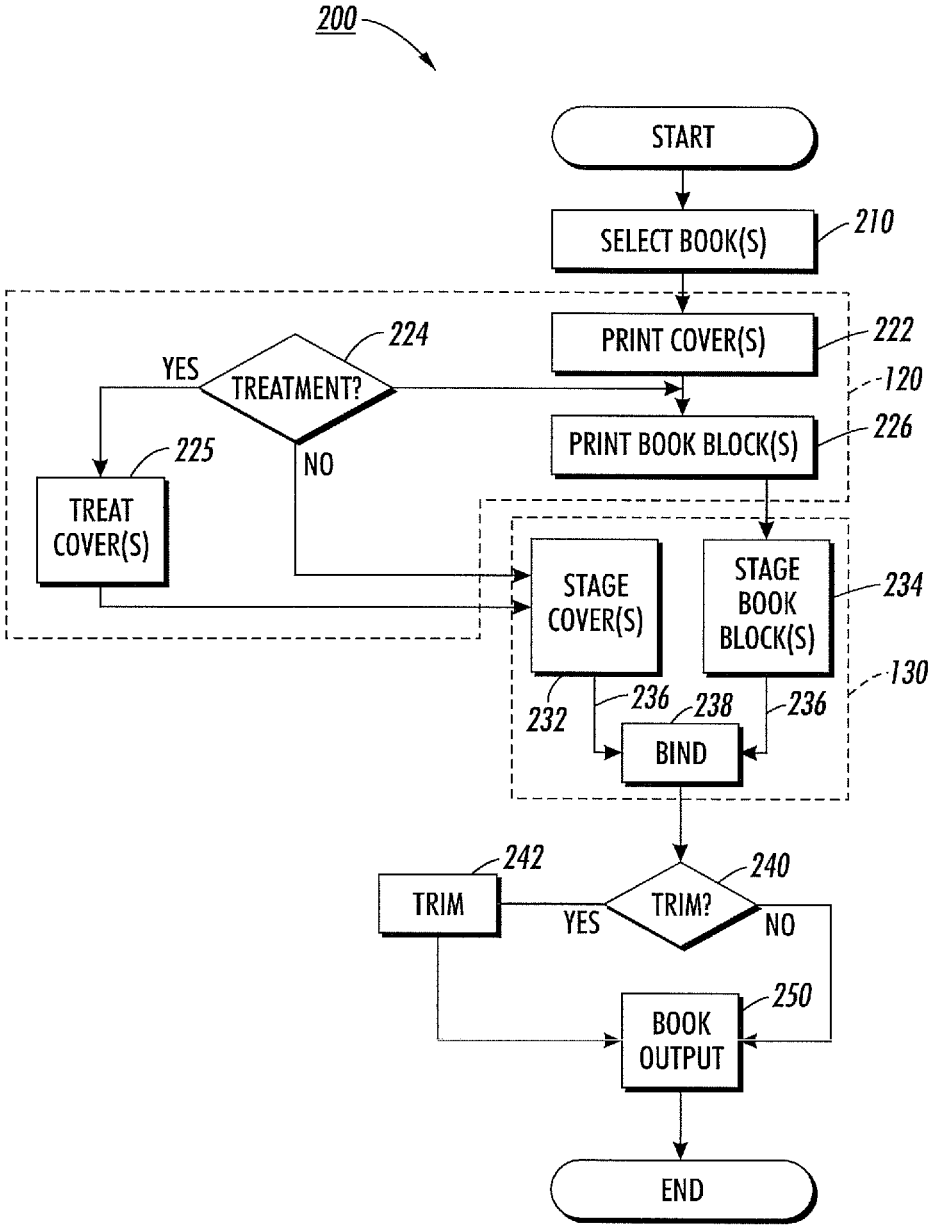
FIG. 2 depicts an exemplary method for in-line book production in accordance with embodiments of the present teachings.

Referring now to FIG. 2, an exemplary method 200 for in-line book production is depicted. In 210, a book selection is made from a populated book list. Again, the selection can be from any known source which is capable of transmitting appropriate book cover and book block information to the common printer. Upon selecting the book to be printed, the common printer generates at least one printed cover at 222. Completion of printing the cover at 222 triggers printing of a corresponding book block on the common printer at 226.

In an optional embodiment, a determination can be made at 224 regarding cover treatment (e.g. lamination, coating, or the like) of the printed cover subsequent to printing the cover at 222. If NO cover treatment is requested or required, the printed cover is automatically delivered to and sequentially staged at 232 of the staging and binding unit. If YES, and cover treatment is requested or required, the printed cover is automatically treated with the appropriate treatment at 225 and then the printed and treated cover is automatically delivered to and sequentially staged at 232 of the staging and binding unit. As indicated above, cover treatment can be by any known laminating, coating or other cover treatment device and is preferably contained within the overall system to avoid manual intervention of the method.

Whether or not the cover is further treated, the printed cover is sequentially staged at 232 in the staging and binding equipment in the order of printing the cover.

Continuing, in response to printing the book cover at 222, the common printer automatically prints a corresponding book block at 226. As indicated, the signal to print the book block is by an output or indicator generated by the printing of the book cover, the output or indicator signaling the common printer to print the corresponding book block. Printed book block(s) are then sequentially staged at 234 in the staging and binding equipment. Staging at 234 is in the order of book block printing, thereby assuring a sequential matching of the staged covers with the staged book blocks.

Also within the staging and binding equipment, a synchronized delivery at 236 of the book cover and book block result in a sequential loading of covers and book blocks to the binding equipment at 238. An alignment or association of a respective cover with a corresponding book block occurs as a one-to-one correspondence according to a book selection and feed order of the cover and book block, and the synchronized cover and book block are bound together within the staging and binding equipment at the binding event 238.

In addition to the exemplary method described above, the in-line book production can include the additional steps of trimming a bound book. A determination is made at 240 regarding trimming of the outer non-bound edges of the bound book. If NO trimming is requested or required, the finished bound book is output at 250. If YES and trimming is requested or required, the bound book is trimmed at 242 and the trimmed finished bound book is output at 250. Trimming is typically subsequent to the binding of the staged cover and corresponding staged book block, and is intended to trim the three exposed sides of the bound book. It will be appreciated that the finishing step of trimming may not be required in all instances and is therefore presented as an option to the book production described.

Although it will be apparent that the cover and/or book block can be encoded, for the in-line book production, encoding can be eliminated due to the accurate one-to-one correspondence of cover and book block achieved with the in-line printing described. Accordingly, encoding of covers and/or book blocks, while not further described, is expressly understood to be within the knowledge of the exemplary embodiments herein. Elimination of encoding can speed the production process and reduce costs.

Although not specifically illustrated, it will be appreciated that one or more books can be printed with the in-line book production of the exemplary embodiments.

Figure 3:
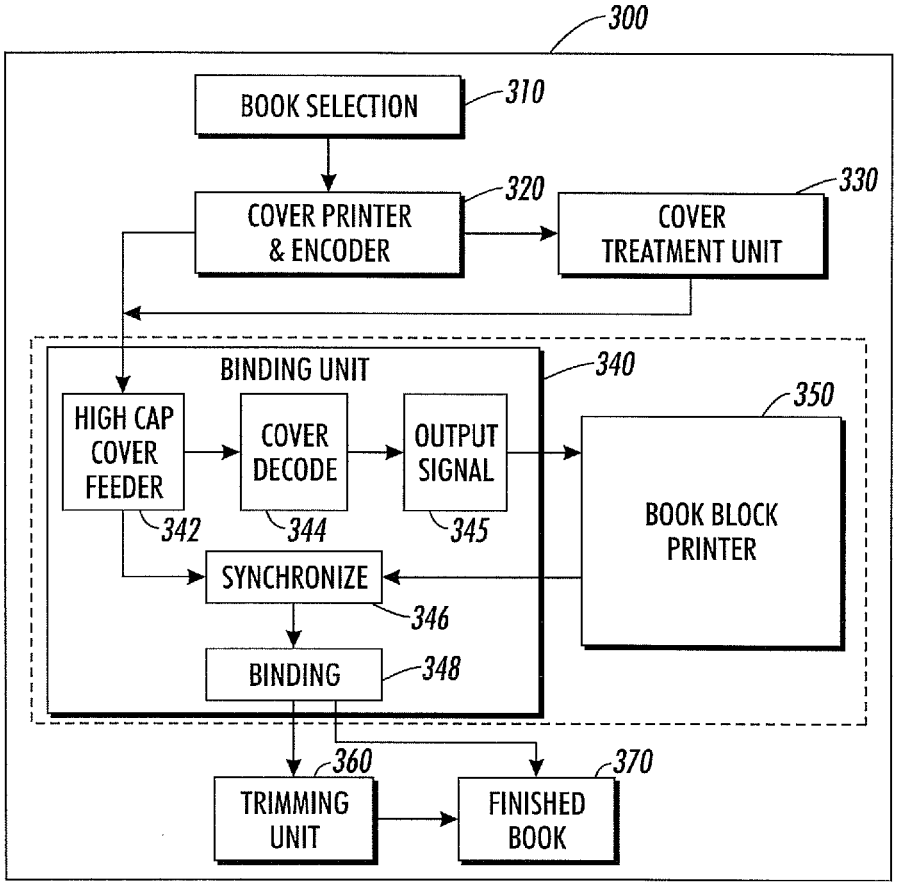
FIG. 3 depicts an exemplary architecture for an off-line book production system in accordance with embodiments of the present teachings.

Referring now to FIG. 3, an exemplary architecture for an off-line book production system 300 is depicted. The exemplary architecture can implement the exemplary off-line methods of book production described below in connection with FIG. 4, as well as other exemplary methods disclosed herein.

In FIG. 3, the system illustrated generally at 300 includes a book selection function 310, a cover printer 320, a binding unit 340, and a book block printer 350. In addition, the system 300 can further include any of a cover treatment unit 330 and a trimming unit 360.

Both the cover printer 320 and book block printer 350 can be a color printer, a black-and-white printer, or one of the printers can be a color printer with the other printer being a black-and-white printer.

Book selection 310 can be, for example, a computerized book selection site of an in-house system, a remote book selection site such as an internet purchase, or other repository such as a library or store. Selection will likely be based upon a listing available for printing at the time of selection.

Although the typical result is an on-demand or local processing of the book selection, such is not intended to limit the subject matter of the exemplary embodiments and book selection need not be in proximity to the book production per se.

The cover printer 320 refers to a printer intended to print only the cover of a book. In an exemplary embodiment, the cover printer 320 will print one or more book covers in a type and quantity indicated at a time of book selection. Additionally, the cover printer 320 can encode the cover at the time of printing. In an exemplary embodiment, each cover can include a descriptive code or similar indicia identifying at least the book block which will be printed for binding with that cover.

The binding unit 340 of the off-line book production system 300 can include multiple functions such as a cover staging area 342, cover decoding 344, signal output 345 for communicating with the book block printer, synchronizing the book block and cover 346, and binding 348. The encoded and subsequently decoded information can be used to guide optional steps other than indicating a book block to be printed in connection with a decoded cover. For example, the encoded information can be used to identify a trimmed size of a bound book, and direct synchronization of the cover, book block, binding of the book block and cover, and routing of the bound book. By way of further example, a thicker book block may require additional glue in a binding operation, and the encoded information on the cover will direct such an operation. By the encoding of the book cover, a substantial amount of printing set up information can be included, thereby avoiding error in outputting a final bound book product. While the multiple additional functions of the binding unit 340 are illustrated as being encompassed within the binding unit 340, it will be apparent that the specified functions can be performed outside of the binding unit 340. For example, any of the cover staging 342, cover decoding 344, and signal output 345 can be incorporated into the cover printer 320. In any event, it is intended that all components described cooperate seamlessly and automatically to output a bound book.

The cover staging area 342 can be a high-speed cover staging area. In another function of the binding unit 340, the encoded information on the cover is decoded by decoder 344 to identify the book block which should be printed to correspond to the decoded cover. The decoded cover information is output as a signal from 345 to the book block printer 350 and the book block printer responds to the signal to print a book block according to the decoded information.

A printed book block is automatically supplied to the synchronizing portion 346 of the binding unit where it is matched with the encoded cover. The binder 348 binds the synchronized cover and book block in a known process. An example of a binder is the CP bourg™ Book Factory binder.

The cover treatment unit 330 is typically positioned down stream of the cover printer 320 and can further treat the printed and encoded cover in a known manner. The cover treatment can include laminating, coating, varnish, veneer, or other treatments to improve the appearance, durability or scuff resistance of the cover. For a laminating or coating type of unit, it will be appreciated that the treatment can be a known fast treatment device as typically used in the printing art. By way of example, laminating can include coating of the cover and then either ultraviolet (UV) curing or air curing the coated cover.

The trimming unit 360 is typically positioned down stream of the binding unit 340 in order to receive a bound book and trim the exposed outer edges of the bound book. An example of a trimming unit 360 is a three-knife trimmer such as that manufactured by Challenge™.

By way of further explanation, it will be appreciated that the term "off-line" is intended to convey the use of distinct cover and book block printers. The integration of these distinct printers in the unique manner described herein results in a streamlined and seamlessly functioning device, similar to the "in-line" system characterized above. The system thus can include several subsystems performing individual functions which as a whole are a cohesively assembled unitary system.

Figure 4:
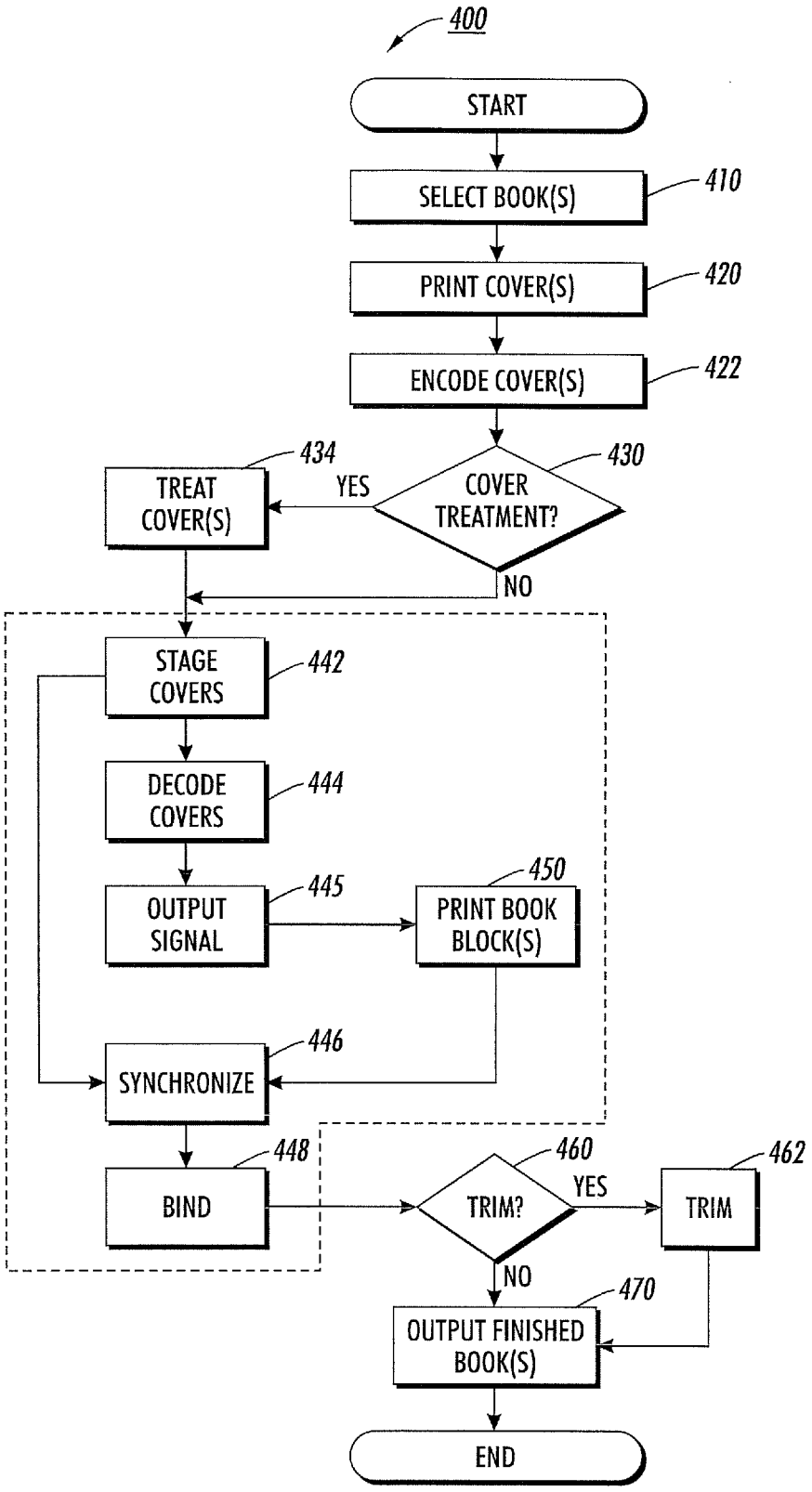
FIG. 4 depicts an exemplary method for off-line book production in accordance with embodiments of the present teachings.

Referring now to FIG. 4, a further exemplary method 400 for off-line book production is illustrated. At 410, a book selection is made from a populated book list. Again, the selection can be from any known source which is capable of transmitting appropriate book cover information to the cover printer. Upon selection of the book to be printed, the cover printer generates at least one printed cover at 420 and further encodes the cover as indicated at 422.

Subsequent to the encoding at 422, a decision is made at 430 regarding treatment of the encoded cover.

If NO cover treatment is requested or required, the encoded cover is transported for staging at 442 within the high capacity staging and transport area of the binding unit. If YES, meaning cover treatment of the encoded cover is requested or required, the one or more covers are treated with lamination or the like as described above at 434. A selectively treated cover is similarly transported for staging at 442 within the high capacity staging and transport area of the staging and binding equipment. Transporting of the cover throughout the system is intended to be an automatic operation. This transport is not intended to limit the scope of the exemplary embodiments.

Once the printed, encoded and optionally treated book cover is received in the cover staging area at 442, the cover is decoded at 444 to identify at least its corresponding book block. This information is supplied by a signal output at 445 to the book block printer via appropriate signal bearing communications and the corresponding book block is then printed at 450 on the book block printer. Printing can occur in singles or multiples of the decoded book cover according to information attached to the book cover at the time of encoding.

Further, printing can be of multiple different book blocks according to multiple different decoded covers.

Once the book block(s) are printed, they are transported for synchronizing at 446 with their corresponding decoded covers within the binder. Subsequent to matching the covers with the binders at 446, the matched covers and book blocks are bound at 448. It will be appreciated that the binding can be by any known type of binding such as, for example, perfect binding. An actual type of binding is not intended to limit the scope of the exemplary embodiments.

Another optional selection in the exemplary embodiment includes a decision at 460, and subsequent to binding, to trim bound book. If NO trimming is requested or required, the bound book is automatically output at 470 as a final product. IfYES, meaning trimming is requested or required, the bound book is trimmed at 462. Subsequent to trimming, the trimmed and bound book is automatically output at 470 as a final product. Trimming of the bound books can be, for example, with a Challenge™ 3-Knife Trimmer, and such a function is not intended to limit the scope of the exemplary embodiments.

As represented at 470, the at least one bound book output from the off-line system corresponds to the input request at 410, and the output bound book can include an optionally treated cover and optionally trimmed outer edges.

While the invention has been illustrated with respect to one or more exemplary embodiments, alterations and/or modifications can be made to the illustrated examples without departing from the spirit and scope of the appended claims. In addition, while a particular feature of the invention may have been disclosed with respect to only one of several embodiments, such feature can be combined with one or more features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of bound book production comprising:

selecting at least one book for printing based on a listing available for printing at a time of the selecting;

printing at least one book cover corresponding to the at least one book on a first printer for printing only print book covers;

encoding the at least one book cover with an identification of at least one book block, information for routing the bound book, an identification of a trimmed size of the bound book, information regarding use of additional glue in a binding operation, and printing set up information for the at least one book block;

pre-feeding the at least one book cover that was encoded into a book binder;

decoding an encoded portion of the at least one book cover in the book binder to retrieve the identification of the at least one book block, the information for routing the bound book, an identification of a trimmed size of the bound book, information regarding use of additional glue in a binding operation, and the printing set up information for the at least one book block;

sending, from the book binder to a second printer, a print request comprising the identification of the at least one book block and the printing set up information for the at least one book block;

printing, on the second printer different from the first printer, the at least one book block according to the printing set up information for the at least one book block received from the book binder;

laminating the book cover subsequent to the printing, subsequent to the encoding, and prior to binding, wherein the laminating comprises coating the cover and curing the coating using ultraviolet radiation;

trimming the book cover prior to binding using a three-knife trimmer;

binding the at least one book block to the at least one book cover using perfect binding and using a high-capacity staging and transport area, whereby the bound book is produced; and routing the bound book according to the information for routing the bound book.

* * * * *